United States Patent [19]

Benichou et al.

[11] Patent Number: 4,530,206

[45] Date of Patent: Jul. 23, 1985

[54] STRINGS FOR TENNIS RACKETS AND RACKETS EQUIPPED WITH SAME

[75] Inventors: Alain Benichou, Pontailler sur Saone; Max Siguier, Aix en Provence, both of France

[73] Assignee: Societe Anonyme D'Explosifs et de Produits Chimiques & Max Siguier, Paris, France

[21] Appl. No.: 528,958

[22] Filed: Sep. 2, 1983

[30] Foreign Application Priority Data

Sep. 2, 1982 [FR] France ..... 82 15019

[51] Int. Cl.[3] ..... D02G 3/04; D02G 3/18; D02G 3/40

[52] U.S. Cl. ..... 57/250; 57/244; 57/255; 57/257; 57/229

[58] Field of Search ..... 57/200, 215-217, 57/229, 232, 234, 240, 241, 242, 249, 250, 251, 244, 255, 257; 428/367

[56] References Cited

U.S. PATENT DOCUMENTS

| | | | |
|---|---|---|---|
| 3,625,809 | 12/1971 | Caroselli et al. | 57/229 X |
| 4,084,399 | 4/1978 | Kanemaru et al. | 57/251 X |
| 4,202,164 | 5/1980 | Simpson et al. | 57/232 |
| 4,381,639 | 5/1983 | Kress | 57/229 |
| 4,391,088 | 7/1983 | Salsky et al. | 57/242 X |
| 4,449,353 | 5/1984 | Toyebi | 57/242 |

*Primary Examiner*—Donald Watkins
*Attorney, Agent, or Firm*—Bacon & Thomas

[57] ABSTRACT

A string for a tennis racket and having a composite cross-section structure having a central reinforcing core comprising twisted Kevlar aromatic polyamide and glass yarns or Kevlar aromatic polyamide yarns, this core layer having a peripheral protective coating of a polyamide.

9 Claims, No Drawings

STRINGS FOR TENNIS RACKETS AND RACKETS EQUIPPED WITH SAME

The present invention relates to a new type of strings, with special mechanical properties, for tennis rackets.

There are at present on the market, two main types of racket strings:

natural strings or catguts, and synthetic strings in nylon, polyurethane, etc.

All these known strings, with the exception of catgut, have the characteristic of being "mono-strand", meaning by this that, the string seen in cross-section and at the macroscopic scale, is composed of a homogeneous material from its periphery to its center.

The elasticity of the known strings in very high, for the considered application, since it is of the order of 20% and possibly even more.

Contrary to the known strings, the strings according to the invention are found to have, in cross-section, a composite structure, meaning that the string contains a reinforcing core with a peripheral coating.

The peripheral coating is provided to prevent abrasion and damage to the core when the ball is received.

Several materials are suitable to constitute this coating, but the best results up to now have been obtained with polyamides, and in particular polyamide-6.

Another suitable polyamide is polyamide-12. The product known as RILSAN (polyamide—11) is unsuitable.

Test have shown that such coatings are absolutely necessary to ensure a long enough life to the strings.

According to the invention, the core is constituted by an organic and/or synthetic material which gives to the strings most of the aforesaid mechanical properties, i.e. bending strength and tensile strength, and has little elasticity (around 4%).

This makes it possible to stretch the strings tightly and to keep them so for several playing sessions.

The choice of material to constitute the core has also proved difficult because it is so important to obtain the required properties.

Tests conducted have shown that, for example, the use of directional glassfibers for the core, such as "rovings" was unsuitable due in particular to the tensile strengths being too low (10 to 15 kg) and also to a complex manufacture, the coating being unsatisfactory.

Glass "assemblies" are also unsuitable, due to material fatigue and insufficient tensile strength.

The best results have been obtained with cores of "twisted yarns" of glass and "KEVLAR" aramide (aromatic polyamide).

It has thus been possible for the first time to produce a material giving a string capable of being tightly stretched, of keeping up such tight stretching for long periods, of fitting very well in the field using "large stringing", with strings stretched to 30 kg for example, and of lasting longer whilst retaining its initial properties.

It has been found that the weight ratio of KEVLAR/glass could be between 1/1 and 3/1 approximately.

The best compromise, considering the economical requirements, seem to be a ratio around 1/1 by weight.

The following examples illustrate the invention without limiting the scope thereof.

EXAMPLES 1 to 3

A composite string according to the invention was produced by coating—according to a known technique—the peripheral coating over the core or central yarn.

The characteristics and properties of the resulting strings are as follows:

| | EXAMPLE 1 | EXAMPLE 2 | EXAMPLE 3 |
|---|---|---|---|
| CORE | "KEVLAR"/glass (% by weight) | | |
| | 50/50 | 50/50 | 75/25 |
| Coating | Polyamide 6 | Polyamide 6 | Polyamide 6 |
| Weight of yarn (g/m) | 1.23 | 0.95 | 0.56 |
| Weight of coating (g/m) | 0.52 | 0.70 | 0.34 |
| Total weight (g/m) | 1.75 | 1.65 | 0.90 |
| Diameter of string (mm) | 1.42 | 1.32 | 0.95 |
| Tensile test (drawing speed (100 mm/min) · | | | |
| Maximum load (kg) | 89 | 52 | 55 |
| Maximum elongation (%) | 3.8 | 3.3 | 4.3 |

It will be recalled that the "twisted yarns" are associates of two plied yarns, twisted together by one or more twisting operations.

The "glass" consists in the aforementioned examples in continuous fibers of 3 μm/diameter.

COMPARATIVE EXAMPLES

Attempts have been made to replace the coating product, polyamide-6, by the "GRILLON BT 40" marketed by the company EMS France, and by "ESTOLANN C-85 A".

Although the first of these products belongs to the polyamides family, neither one has given the expected results.

EXAMPLES 4 and 5

Both these examples illustrate strings according to the invention having a "KEVLAR"/"KEVLAR" core.

The special characteristic of these strings is that they have parallel KEVLAR yarns (constituting the core) and KEVLAR yarns wound around said core (which constitute the cover), the whole assembly being coated by extrusion with a thermoplastic material (such as for example: polyamide-6 or polyamide-12).

| | EXAMPLE 4 | EXAMPLE 5 |
|---|---|---|
| CORE | Core of "KEVLAR 49" Count: 5067 dtex Cover in "KEVLAR 29" Count = 220 dtex | Core of "KEVLAR 49" Count = 7800 dtex Cover in "KEVLAR 29" Count = 220 dtex |
| COATING | Polyamide 6 | Polyamide 6 |
| mean diameter of string (mm) | 1.28 to 1.30 | 1.34 to 1.42 |
| Weight/meter of string (g/m) | 1.40 | 1.59 |
| TENSILE TEST | | |
| Drawing speed = 100 mm/minute | | |
| Maximum Load | ($\overline{99.4}$ ± 6%) kg | ($\overline{136.4}$ ± 2.4%) kg |
| Maximum Elongation | ($\overline{2.5}$ ± 4.5%) % | ($\overline{2.7}$ ± 8%) % |

What we claim is:

1. A string for a tennis racket having a composite cross-section structure having a central reinforcing core comprising twisted Kevlar aromatic polyamide and glass yarns in which the Kevlar/glass yarns are present in a weight ratio of between about 1/1 and 3/1; said core layer having a peripheral protective coating of a polyamide.

2. A string as claimed in claim 1, wherein the KEVLAR/glass weight ratio in the twisted yarns comprising the core is around 1/1.

3. A string as claimed in claim 1, with a core of twisted glass and "KEVLAR" yarns, wherein said string is one of the three presenting the following characteristics:

| | | | |
|---|---|---|---|
| Weight ratio KEVLAR/GLASS | 50/50 | 50/50 | 75/25 |
| coating deposited | | Polyamide-6 | |
| weight of core (g/m) | 1.23 | 0.95 | 0.56 |
| weight of coating (g/m) | 0.52 | 0.70 | 0.34 |
| total weight | 1.75 | 1.65 | 0.90 |
| diameter of string (mm) | 1.42 | 1.32 | 0.95 |

4. A string for a tennis racket having a composite cross-section structure having a central reinforcing core comprising a group of parallel yarns of Kevlar aromatic polyamide covered with wound Kevlar yarns; said core layer having a peripheral polyamide coating and resulting in a string having one of the following sets of characteristics:

| | | |
|---|---|---|
| CORE | Core of "KEVLAR 49" Count = 5067 dtex Cover in "KEVLAR 29" Count = 220 dtex | Core of "KEVLAR 49" Count = 7800 dtex Cover in "KEVLAR 29" Count = 220 dtex |
| COATING | Polymaide 6 | Polyamide 6 |
| Mean diameter of string (mm) | 1.28 to 1.30 | 1.34 to 1.42 |
| Weight/meter of string (g/m) | 1.40 | 1.59 |
| TENSILE TEST | | |
| Drawing speed = 100 mm/minute | | |
| Maximum Load | ($\overline{99.4}$ ± 6%) kg | ($\overline{136.4}$ ± 2.4%) kg |
| Maximum Elongation | ($\overline{2.5}$ ± 4.5%) % | ($\overline{2.7}$ ± 8%) % |

5. A string as claimed as claim 2 wherein the peripheral coating is polyamide-6.

6. A string as claimed in claim 1 wherein the peripheral coating is polyamide-6.

7. A string as claimed in claim 2 wherein the peripheral coating is polyamide-12.

8. A string as claimed in claim 1 wherein the peripheral coating is polyamide-12.

9. Tennis rackets, of the type with large stringing, stretched to about 30 kg, wherein said rackets are equipped with strings as claimed in any one of claims 1 to 8.

* * * * *